US006922169B2

(12) United States Patent
Moh'd Izzat et al.

(10) Patent No.: US 6,922,169 B2
(45) Date of Patent: Jul. 26, 2005

(54) ANTENNA, BASE STATION AND POWER COUPLER

(75) Inventors: Narian Moh'd Kheir Moh'd Izzat, Frankfort, IL (US); Martin Lee Zimmerman, Chicago, IL (US); Kevin Eldon Linehan, Lemont, IL (US)

(73) Assignee: Andrew Corporation, Orland Park, IL (US)

( * ) Notice: Subject to any disclaimer, the term of this patent is extended or adjusted under 35 U.S.C. 154(b) by 43 days.

(21) Appl. No.: 10/367,055

(22) Filed: Feb. 14, 2003

(65) Prior Publication Data

US 2004/0160361 A1 Aug. 19, 2004

(51) Int. Cl.[7] ..... H01Q 3/00

(52) U.S. Cl. ..... 342/360; 455/562.1; 455/276.1; 333/159

(58) Field of Search ..... 342/360, 368–384; 455/562.1, 276.1; 333/159

(56) References Cited

U.S. PATENT DOCUMENTS

| | | | | | |
|---|---|---|---|---|---|
| RE28,546 | E | * | 9/1975 | Foldes | 342/361 |
| 4,060,808 | A | * | 11/1977 | Foldes | 342/362 |
| 4,335,388 | A | | 6/1982 | Scott et al. | |
| 4,626,858 | A | * | 12/1986 | Copeland | 342/374 |
| 4,799,065 | A | | 1/1989 | Thompson | |
| 4,827,270 | A | | 5/1989 | Udagawa et al. | |
| H1034 | H | * | 3/1992 | Lohrmann | 343/781 CA |
| 5,151,706 | A | | 9/1992 | Roederer et al. | |
| 5,473,294 | A | * | 12/1995 | Mizzoni et al. | 333/159 |
| 5,949,370 | A | | 9/1999 | Smith et al. | |
| 6,198,458 | B1 | * | 3/2001 | Heinz et al. | 343/853 |
| 6,208,313 | B1 | | 3/2001 | Frank et al. | |
| 6,317,100 | B1 | | 11/2001 | Elson et al. | |
| 2002/0080068 | A1 | | 6/2002 | Kim et al. | |
| 2003/0153361 | A1 | * | 8/2003 | Mori et al. | 455/562 |
| 2004/0063467 | A1 | * | 4/2004 | Shapira et al. | 455/562.1 |
| 2004/0090286 | A1 | | 5/2004 | Runyon | |

FOREIGN PATENT DOCUMENTS

| | | |
|---|---|---|
| EP | 0 543 509 B1 | 5/1993 |
| WO | WO 96/14670 | 5/1996 |
| WO | WO 02/05383 A1 | 1/2002 |
| WO | WO 02/15326 A2 | 2/2002 |
| WO | WO 02/50953 A1 | 6/2002 |
| WO | WO 02/061878 A2 | 8/2002 |

OTHER PUBLICATIONS

U.S. Appl. No. 60/264,325.*

B.M. Schiffman, A New Class of Broad–Band Microwave 90–Degree Phase Shifters, IEEE Transactions on Microwave Theory and Techniques, , vol. 6(2), p. 232–237, Apr. 1958.*

R.W. Beatty, A Differential Microwave Phase Shifter (Correspondence), IEEE Transactions on Microwave Theory and Techniques, vol. 12(2), p. 250–251, Mar. 1964.*

(Continued)

*Primary Examiner*—Thomas H. Tarcza
*Assistant Examiner*—F H Mull
(74) *Attorney, Agent, or Firm*—Welsh & Katz, Ltd.

(57) ABSTRACT

A power coupler including a differential phase shifter for differentially adjusting the relative phase between signals on a pair of signal lines; and a hybrid coupler which is coupled to the pair of signal lines. The power coupler may be employed in an antenna including first and second signal lines; a differential phase shifter for differentially adjusting the relative phase between signals on the first and second signal lines; a first set of one or more radiating elements; a second set of one or more radiating elements; and a hybrid coupler having a first port coupled to the first signal line, a second port coupled to the second signal line, a third port coupled to the first set of radiating elements, and a fourth port coupled to the second set of radiating elements. Elevation beam width is adjustable independently of azimuthal beam width.

49 Claims, 6 Drawing Sheets

OTHER PUBLICATIONS

D.A. Ellerbruch, Analysis of a Differential Phase Shifter, IEEE Transactions on Microwave Theory and Techniques, vol. 12(4), p. 453–459, Jul. 1964.*

H. Iwakura et al., 90–degree differential phase shifter using meander–line networks, Electronics–and–Communications–in–Japan Part–1, vol. 68(10), p. 55–62, Oct. 1985.*

V.P. Meschanov et A new structure of microwave ultrawide–band differential phase shifter, IEEE Transactions on Microwave Theory and Techniques, vol. 42(5), p. 762–765, May 1994.*

F.V. Minnaa et al., A novel ultrawideband microwave differential phase shifter, IEEE Transactions on Microwave Theory and Techniques, vol. 45(8), p. 1249–1252, Aug. 1997.*

Ahmad, "A CDMA Network Architecture Using Optimized Sectoring." *IEEE Transactions on Vehicular Technology*, vol. 51, No. 3, May 2002.

* cited by examiner

ANTENNA, BASE STATION AND POWER COUPLER

FIELD OF THE INVENTION

The present invention relates in one aspect to an antenna, in another aspect to a base station, and in another aspect to a power coupler. The invention is of use generally, but not exclusively, in land-based communications, typically in a mobile wireless communications network.

BACKGROUND OF THE INVENTION

WO 02/05383 discloses a land based cellular communication system. One embodiment employs a ten element array with variable downtilt, variable azimuth beam width and variable azimuth beam angle. The antenna elements are coupled to an adjustable power divider which divide power between inner and outer radiating elements to adjust the azimuth beam width. The power dividers each include a pair of hybrid couplers and a phase shifter between the hybrid couplers. Another embodiment employs a four element array, arranged in a diamond configuration. Azimuth and elevation beam width are adjusted together by a single power divider. Azimuth and elevation beam angle are adjusted independently by phase shifters.

U.S. Pat. No. 5,949,370 discloses a positionable satellite antenna with a reconfigurable beam. Adjustment of the relative phases and amplitudes of the signals of the respective feed elements results in adjustment of the configuration of the beam.

BRIEF DESCRIPTION OF PREFERRED EMBODIMENT

A preferred embodiment provides in a first aspect a land-based antenna including an array of radiating elements for transmitting and/or receiving radiation via a beam having an elevation beam width and an azimuth beam width; and an elevation beam width adjuster for adjusting the elevation beam width substantially independently of the azimuth beam width, whereby the elevation beam width can be adjusted with substantially no variation in the azimuth beam width.

A preferred embodiment provides in a second aspect a power coupler including a differential phase shifter for differentially adjusting the relative phase between signals on a pair of signal lines; and a hybrid coupler which is coupled to the pair of signal lines.

The use of a differential phase shifter can be contrasted with WO 02/05383 which only adjusts phase in one input to the hybrid coupler, the phase of the other input remaining constant.

A preferred embodiment provides in a third aspect an antenna including first and second signal lines; a differential phase shifter for differentially adjusting the relative phase between signals on the first and second signal lines; a first set of one or more radiating elements; a second set of one or more radiating elements; and a hybrid coupler having a first port coupled to the first signal line, a second port coupled to the second signal line, a third port coupled to the first set of radiating elements, and a fourth port coupled to the second set of radiating elements.

A preferred embodiment provides in a fourth aspect a land-based mobile wireless communications network base station comprising a plurality of antennas each having a beam width which is adjustable independently of the beam width of the other antennas.

The beam width may be azimuthal and/or elevation beam width.

A preferred embodiment provides in a fifth aspect an antenna including 2n+1 radiating modules; and a cascaded network of 2n−1 variable power couplers for varying the division of power between the radiating modules. The power couplers may include a differential phase shifter for differentially adjusting the relative phase between signals on a pair of signal lines; and a hybrid coupler which is coupled to the pair of signal lines, as described above with reference to the second aspect. Alternatively, a conventional power coupler may be used—such as the power coupler described in WO 02/05383.

BRIEF DESCRIPTION OF THE DRAWINGS

Embodiments of the invention will now be described by way of example with reference to the accompanying drawings in which.

DETAILED DESCRIPTION OF BEST MODE FOR CARRYING OUT THE INVENTION

Figure 1:
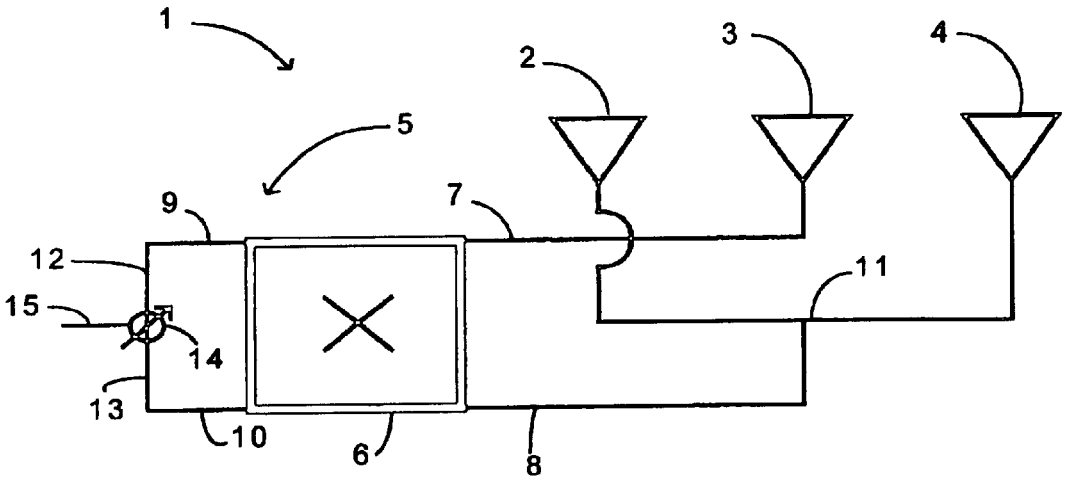
FIG. 1 is a front view of a panel antenna with variable azimuth beam width.

Referring to FIG. 1, an antenna 1 with variable azimuth beam width is shown comprising three radiating elements 2–4 arranged in a horizontal line and coupled to a power divider/combiner 5. The power divider/combiner 5 comprises a 90 degree ring hybrid having antenna ports 7,8 and input/output ports 9,10. The antenna port 8 is coupled to outer elements 2,4 via a splitter/combiner 11, and the antenna port 7 is coupled to the central element 3. The input/output ports 9,10 are coupled to respective signal lines 12,13 of a differential phase shifter 14. When working in transmit mode, the phase shifter 14 receives input signals on feed line 15, splits the signal into two output signals of equal amplitude on lines 12,13, and provides an adjustable differential phase shift between the output signals. Equivalently, in receive mode the phase shifter 14 combines signals on lines 12,13 with an adjustable differential relative phase shift. As used herein, the term "differential phase shifter" means an adjustable device which increases the phase of a first signal line, while simultaneously decreases the phase of another signal line by an approximately equal amount.

The relative power output/input to/from antenna ports 7, 8 varies as a function of the position of the phase shifter 14. It will be noted that the power coupler 5 is substantially non-attenuating—that is, it does not employ any attenuators (such as resistors) which would result in power loss and overheating.

The differential phase shifter 14 can be any device which simultaneously increases the phase of one line 9, 10 whilst decreasing the phase of the other line by an approximately equal amount. Preferably an electromechanical phase shifter is used, which varies phase by adjusting the relative positions of physical components. For example, referring to FIG. 2, the phase shifter may comprise a wiper 20 which has a sliding contact with a curved line 22 between signal lines 12,13. Phase is adjusted by rotating wiper 20 about pivot point 21. Alternatively, an arrangement of the type shown in WO 96/14670 may be used. The phase shifter may provide continuous adjustment, or may have two or more discrete settings. For instance the phase shifter may have one setting for 33 degree azimuth beam width, and another setting for 45 degree azimuth beam width.

Figure 3:
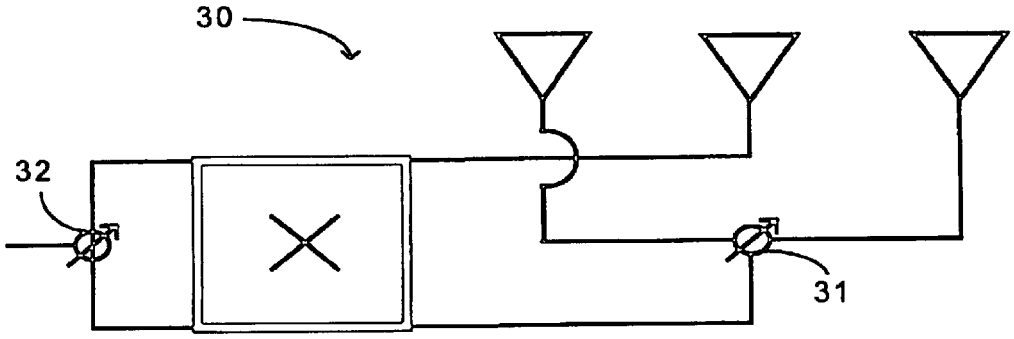
FIG. 3 is a front view of a panel antenna with variable azimuth beam width and beam angle.

The principles of FIG. 1 can also be used to provide azimuth beam steering as shown in FIG. 3. The antenna 30 of FIG. 3 is identical to the antenna 1 of FIG. 1, except that splitter/combiner 11 is replaced by a second differential phase shifter 31. Adjustment of phase shifter 32 provides azimuth beam width adjustment, and adjustment of phase shifter 31 provides a progressive phase shift between the three antenna elements, thus providing azimuth beam steering.

Figure 2:
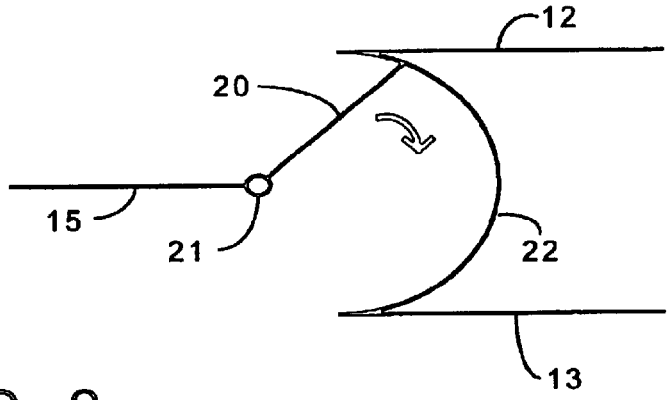
FIG. 2 shows a differential phase shifter in detail.
Figure 4:
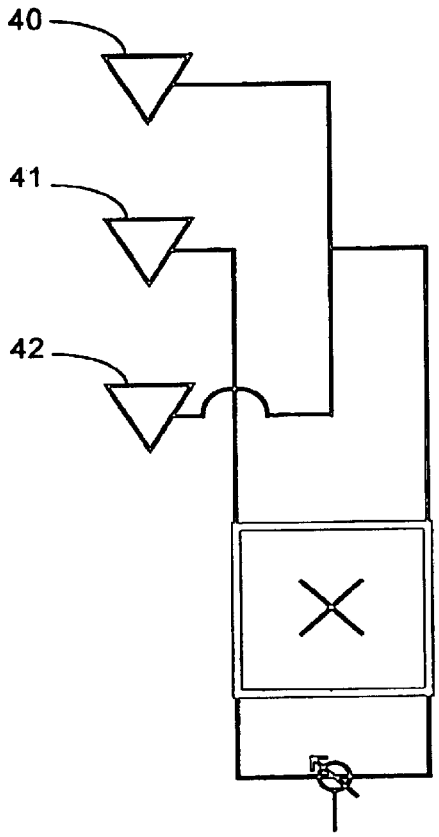
FIG. 4 is a front view of a panel antenna with variable elevation beam width.
Figure 5:
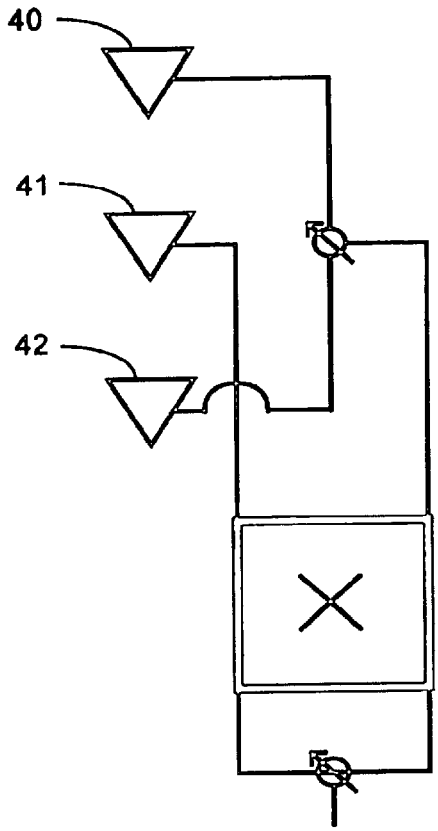
FIG. 5 is a front view of a panel antenna with variable elevation beam width and beam angle.

Furthermore, the principles of FIGS. 1–3 can be extended to providing variable downtilt and elevation beam width as shown in FIGS. 4 and 5. FIGS. 4 and 5 are identical to FIGS. 1 and 3 except that the antenna elements 40–42 are mounted in a vertical line.

Figure 6:
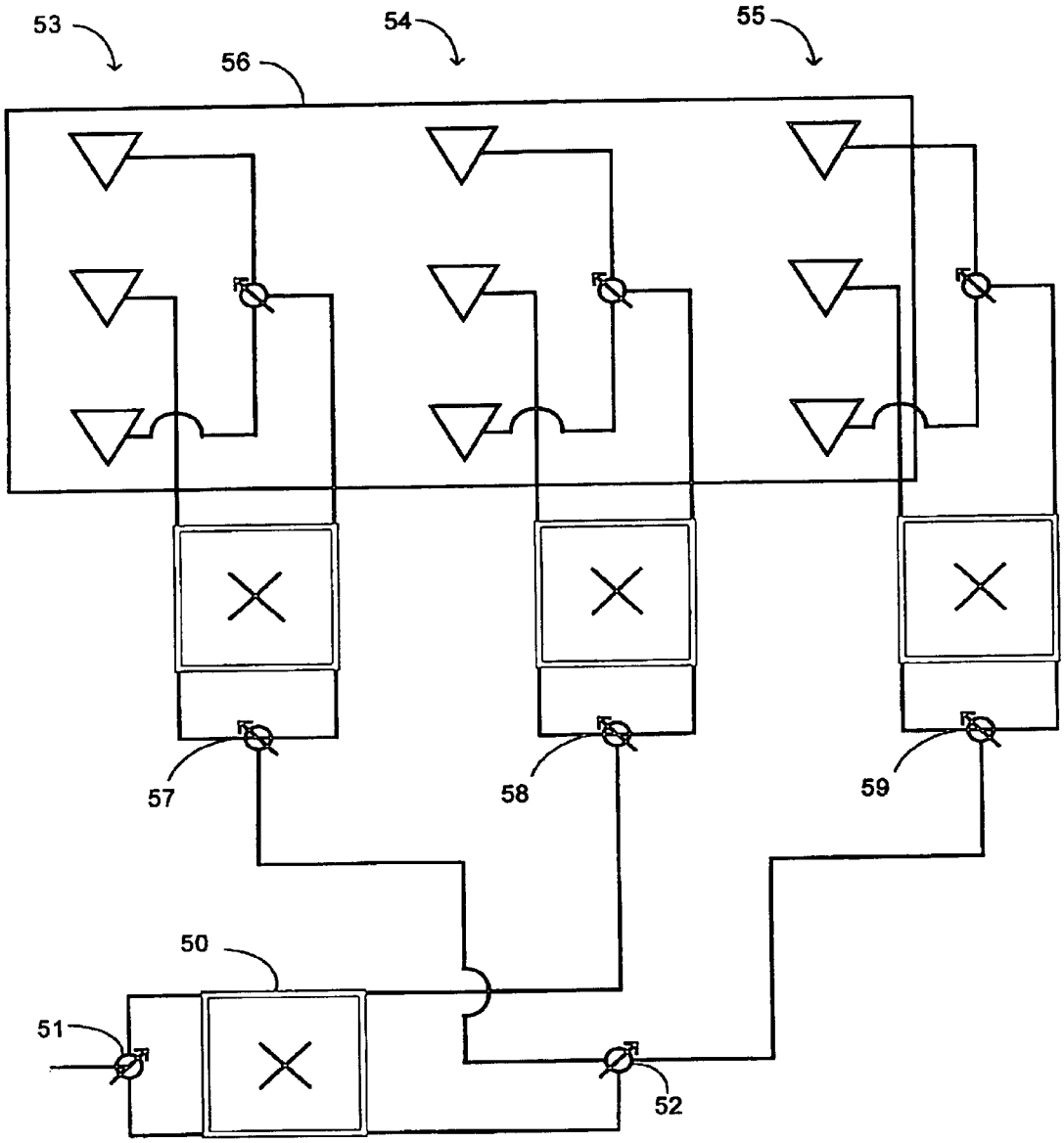
FIG. 6 is a front view of a panel antenna system with a three column array with adjustable beam width and beam angle in both azimuthal and elevation directions.

FIGS. 1–5 show linear arrays of antenna elements. However it will be appreciated that the principles exemplified in FIGS. 1–5 can be extended to provide a two-dimensional array with variable beam angle and beam width, each independently adjustable in both azimuth and elevation directions. An example is given in FIG. 6. First, second and third vertically oriented sub-arrays 53–55 are each coupled to respective power dividers and phase shifters which provide variable elevation beam angle and variable elevation beam width. Variable azimuth beam width and angle is provided by a main hybrid coupler 50 and main phase shifters 51,52. Also shown in FIG. 6 is a ground plane 56 mounted behind the elements 53–55. A ground plane is also provided with the antennas of FIGS. 1,2 and 4,5 but is omitted for clarity.

It should be noted that azimuth and elevation beam width can be adjusted independently in the embodiment of FIG. 6. That is, elevation beam width can be adjusted whilst keeping the azimuth beam width substantially constant, and vice versa. Each parameter is adjusted by its own respective beam width adjuster (ie phase shifter 51 for adjusting azimuth beam width, and three phase shifters 57–59 for adjusting elevation beam width). Optionally the array of FIG. 6 could be rotated by 90 degrees: in this case phase shifter 51 would adjust elevation beam width, and phase shifters 57–59 would adjust azimuth beam width.

The phase shifters 57–59 may be driven together in tandem so as to provide uniform elevation beam width adjustment across the width of the array. This may be achieved by means of a mechanical linkage such as a drive rod which drives all three phase shifters 57–59 together.

Although three antenna elements are shown in each line of antenna elements in FIGS. 1–6, it will be appreciated that more elements can be added as required. For instance the horizontal lines of radiating elements may be extended so as to provide a relatively narrow vertically oriented "fan" type of beam pattern, which could for instance be directed onto a tall narrow building. The elevation beam width can be varied independently of the azimuth beam width—enabling the elevation beam width to be adjusted for the particular height of building. Another potential application for independently adjustable elevation beam width is in a "micro-cellular" mobile wireless communications network. A "micro-cellular" network is a network with a much smaller size and therefore higher capacity than a conventional mobile phone cell, and may be implemented, for example, inside a building. In such a "micro-cellular" network, independent adjustment of elevation beam width may assist network optimisation.

Figure 7:
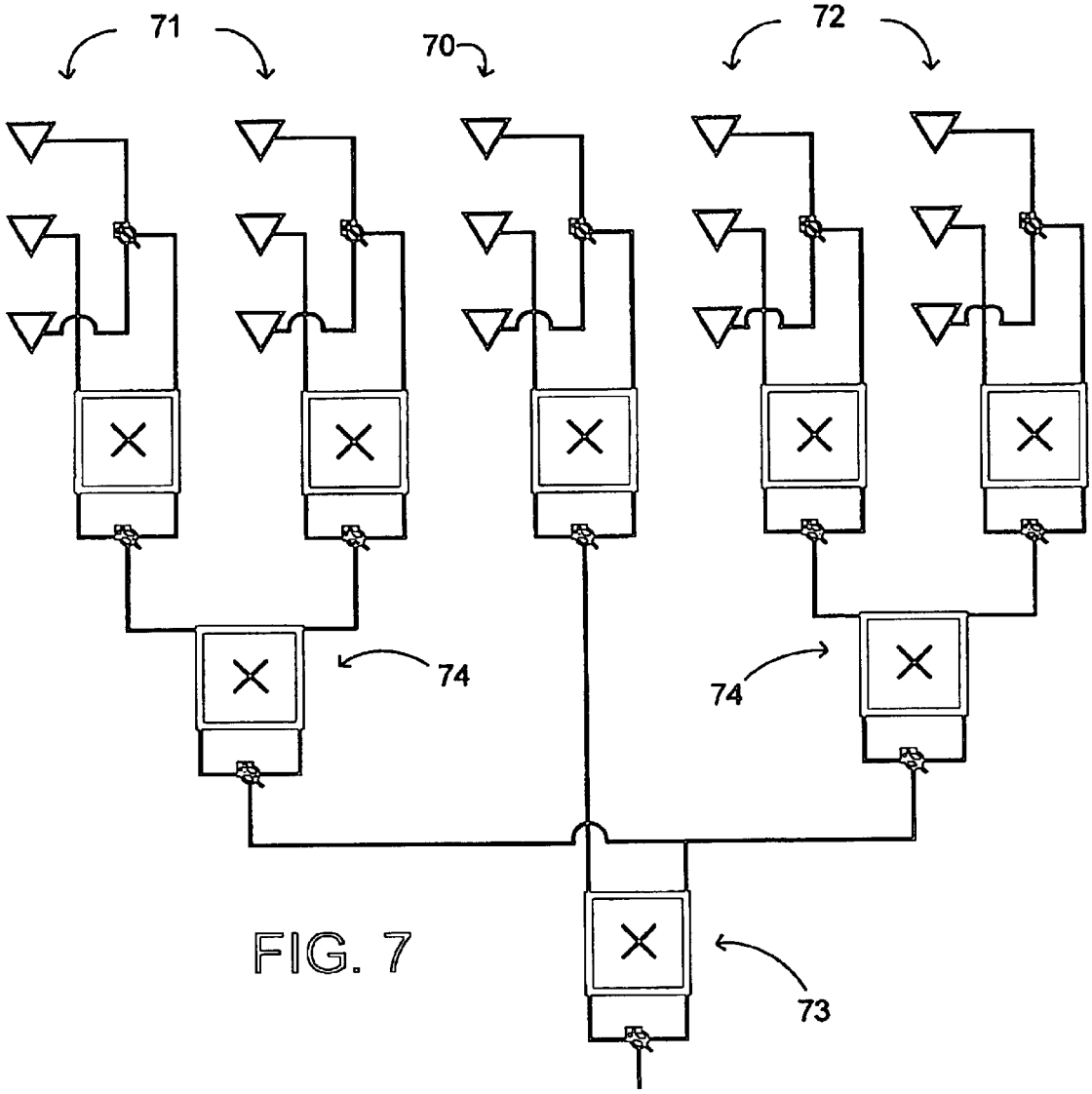
FIG. 7 is a variant of FIG. 6 showing a five column array.

An example is shown in FIG. 7, which shows a five column array including a central column 70, a pair of left-hand columns 71 and a pair of right-hand columns 72. Main power divider 73 varies the division of power between the central column 70 and the outer columns 71,72. Subsidiary power dividers 74 vary the division of power between the inner and outer column of each pair 71,72.

Figure 8:
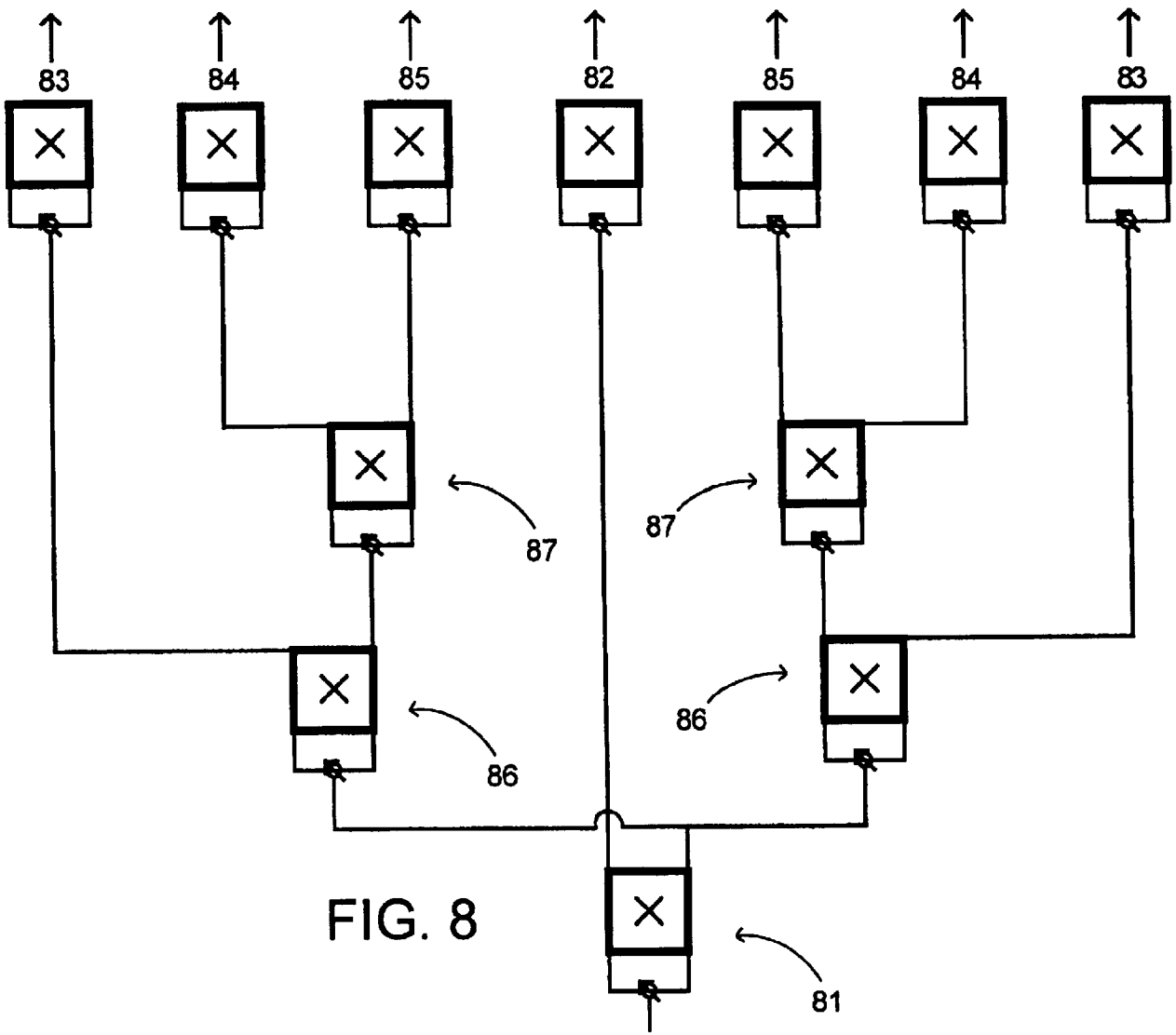
FIG. 8 is a further variant of FIG. 6 showing a seven column array.

It will be appreciated that the array can be extended indefinitely for each beam axis. That is, any array can be constructed having 2n+1 rows and 2m+1 columns. Power division between the rows is controlled by a cascaded network of 2n−1 power dividers arranged with n cascade levels. Equivalently, power division between the columns is controlled by a cascaded network of 2m−1 power dividers arranged with m cascade levels. Thus, for example a pair of additional rows and a cascaded power divider network can be added to the 3*5 array of FIG. 7 in the same manner, to provide a 5*5 array (not shown). Alternatively, an additional pair of columns can be added as shown in FIG. 8. FIG. 8 shows part of the feed network for an array with seven columns and three rows, with three power dividers 81,86,87 in series controlling the division of power between the columns. The radiating elements are omitted for clarity but their positions are indicated by numerals 82–85. Power divider 81 varies the division of power between a central column 82 and six outer columns 83–85. First subsidiary power dividers 86 vary the division of power between the outermost columns 83 and the inner columns 84,85. Second subsidiary power dividers 87 vary the division of power between columns 84 and 85.

Note that the panel is omitted from FIGS. 7 and 8 for clarity.

Figure 9:
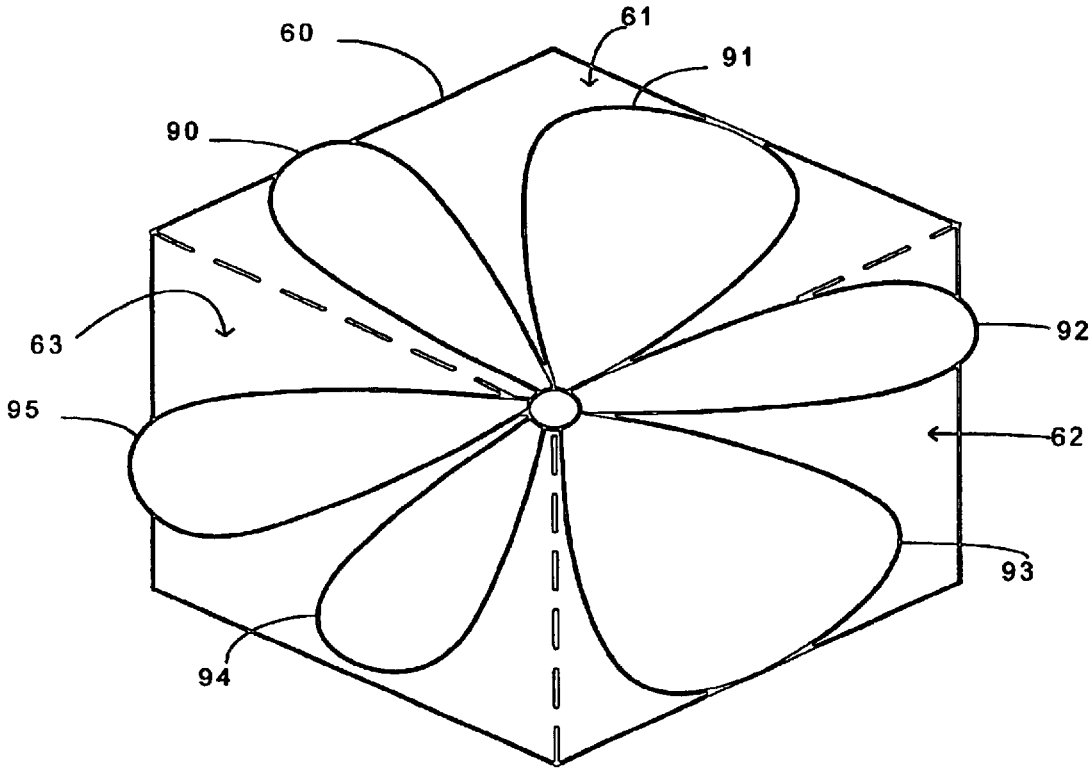
FIG. 9 is a plan view of a single cell of a cellular network.
Figure 10:
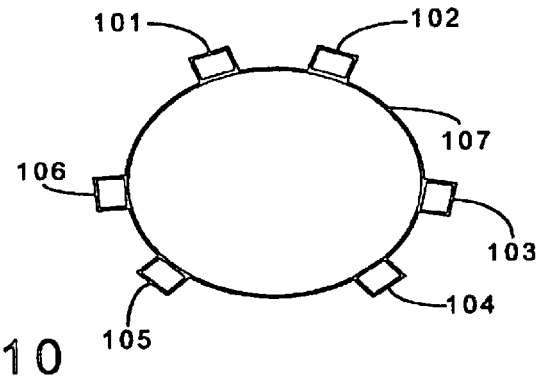
FIG. 10 is a detailed view of a base station.

Referring now to FIG. 9, a base station services a hexagonal cell containing three 120 degree sub-cells 61–63. The cell forms part of a cellular or micro-cellular mobile wireless communications network. A schematic plan view of the base station is shown in detail in FIG. 10. The base station has three pairs of antennas mounted on a support 107. Antennas 101,102 have beams 90,91 respectively which together service sub-cell 61. Antennas 103,104 have beams 92,93 respectively which together service sub-cell 62. Antennas 105,106 have beams 94,95 respectively which together service sub-cell 63.

Each of the antennas 101–106 has variable downtilt, azimuth beam width and azimuth beam angle as described above. Optionally the antennas 101–106 may also incorporate variable elevation beam width. For example the antennas 101–106 may be panel antennas as shown in FIGS. 6–8.

The antennas 101–106 may be 45 degree dual polarisation antennas, as described for example in WO 02/50953.

The invention provides an antenna in which beam width and/or angle can be varied independently in both azimuth and elevation directions. The antenna thus allows great flexibility in control of the beam of the antenna to actively control the region covered by an antenna beam in a mobile wireless communications network.

The invention is of use generally, but not exclusively, in land-based communications, typically in a mobile wireless communications network. The invention is applicable to a wide range of wireless communications network protocols or frequency bands, including but not limited to cellular, PCS and UMTS.

Where in the foregoing description reference has been made to integers or components having known equivalents then such equivalents are herein incorporated as if individually set forth.

Although this invention has been described by way of example it is to be appreciated that improvements and/or modifications may be made thereto without departing from the scope or spirit of the present invention.

What is claimed is:

1. In a mobile wireless communications network, a land-based antenna including an array of radiating elements for transmitting and/or receiving radiation via a beam having an elevation beam widths an azimuth beam width, and a beam angle;

an elevation beam width adjuster for adjusting the elevation beam width substantially independently of the azimuth beam width, whereby the elevation beam width can be adjusted with substantially no variation in the azimuth beam width; and a beam angle adjuster for adjusting the beam angle.

2. An antenna according to claim 1 wherein the elevation beam width adjuster varies the power of signals supplied to or received from the radiating elements so as to vary the elevation beam width.

3. An antenna according to claim 2 wherein the elevation beam adjuster varies the power ratio between one or more inner radiating elements and one or more outer radiating elements.

4. An antenna according to claim 1 wherein the elevation beam width adjuster includes an electromechanical phase shifter which adjusts phase by means of relatively moving components.

5. An antenna according to claim 1 wherein the array is a two dimensional array, and the antenna includes an azimuthal beam width adjuster for adjusting the azimuthal beam width independently of the elevation beam width, whereby the azimuthal beam width can be adjusted with substantially no variation in the elevation beam width.

6. An antenna according to claim 1 wherein the beam angle adjuster adjusts an elevation beam angle of the antenna.

7. An antenna according to claim 1 wherein the beam angle adjuster adjusts an azimuth beam angle of the antenna.

8. An antenna according to claim 1 wherein the beam has an elevation beam width, an azimuth beam angle and an azimuth beam width, and the antenna further includes an elevation beam width adjuster for adjusting the beam width; an azimuth beam angle adjuster for adjusting the azimuth beam angle; and an azimuth beam width adjuster for adjusting the azimuth beam width.

9. A land-based mobile wireless communications network including an antenna according to claim 1.

10. A power coupler including a differential phase shifter for differentially adjusting the relative phase between signals on a pair of signal lines;

a hybrid coupler which is coupled to the pair of signal lines a pair of subsidiary signal lines coupled to one of the signal lines: and an adjustable phase shifter for adjusting the relative phase between signals on the pair of subsidiary signal lines.

11. A power coupler according to claim 10 wherein the differential phase shifter adjusts the length of one of the pair of signal lines compared to the length of the other signal line.

12. A power coupler according to claim 10 wherein the hybrid coupler is a 90 degree hybrid coupler.

13. A power coupler according to claim 10 wherein the differential phase shifter includes a splitter/combiner coupled to the pair of signal lines.

14. A power coupler according to claim 10 wherein the differential phase shifter comprises an electromechanical phase shifter which adjusts phase by means of relatively moving components.

15. A power coupler according to claim 14 wherein the differential phase shifter includes a slider having a sliding contact with a transmission line which is coupled to the pair of signal lines.

16. A power coupler according to claim 10 wherein the differential phase shifter is adjustable between two or more discrete positions.

17. An antenna including first and second signal lines; a differential phase shifter for differentially adjusting the relative phase between signals on the first and second signal lines; a first set of one or more radiating elements; a second set of one or more radiating elements; and a hybrid coupler having a first port coupled to the first signal line, a second port coupled to the second signal line, a third port coupled to the first set of radiating elements, and a fourth port coupled to the second set of radiating elements.

18. An antenna according to claim 17 wherein adjustment of the differential phase shifter adjusts the beam width of the antenna.

19. An antenna according to claim 17 wherein the first set of radiating elements comprises one or more an inner elements, and the second set of radiating elements comprises one or more first outer elements arranged on a first side of the inner element and one or more second outer elements arranged on a second side of the inner elements(s) opposite to the first side.

20. An antenna according to claim 17 wherein the second set of radiating elements comprises a first subset of elements and a second subset of elements, and the antenna includes an adjustable phase shifter for adjusting the relative phase between the first and second subsets of elements.

21. An antenna according to claim 20 wherein adjusting the relative phase between the first and second subsets of elements adjusts a beam angle of the antenna.

22. An antenna according to claim 17 wherein the antenna is land based and the first set of elements is mounted at a different height to the second set of elements.

23. An antenna according to claim 17 wherein the antenna is land based and the first set of elements is mounted at a different horizontal position to the second set of elements.

24. An antenna system comprising two or more antennas according to claim 17, arranged with the radiating elements together forming a two dimensional array.

25. An antenna system according to claim 17 further comprising a power coupler which is coupled to the two or more antennas.

26. An antenna according to claim 17 wherein the antenna is a land-based mobile wireless communications network antenna.

27. A land-based mobile wireless communications network including an antenna according to claim 17.

28. An antenna comprising:

a. a main power coupler including first and second signal lines; a first differential phase shifter for differentially adjusting the relative phase between signals on the pair of signal lines; a first hybrid coupler having a first port coupled to the first signal line, a second port coupled to the second signal line, a third port, and a fourth port b. a first sub-array including third and fourth signal lines; a second differential phase shifter for differentially adjusting the relative phase between signals on the third and fourth signal lines; a first set of one or more radiating elements; a second set of one or more radiating elements; a second hybrid coupler having a first port coupled to the third signal line, a second port coupled to the fourth signal line, a third port coupled to the first set of radiating elements, and a fourth port coupled to the second set of radiating elements; and c. a second sub-array including fifth and sixth signal lines; a third differential phase shifter for differentially adjusting the relative phase between signals on the fifth and sixth signal lines; a third set of one or more radiating elements; a fourth set of one or more radiating elements; a third hybrid coupler having a first port coupled to the fifth signal line, a second port coupled to the sixth signal line, a third port coupled to the third set of radiating elements, and a fourth port coupled to the fourth set of radiating elements wherein the third and fourth signal lines of the first sub-array are coupled to the third output port of the main coupler, and the fifth and sixth signal lines of the second sub-array are coupled to the fourth output port of the main coupler.

29. An antenna according to claim 28 including a third sub-array including seventh and eighth signal lines; a fourth differential phase shifter for differentially adjusting the relative phase between signals on the seventh and eighth signal lines; a fifth set of one or more radiating elements; a sixth set of one or more radiating elements; a fourth hybrid coupler having a first port coupled to the seventh signal line, a second port coupled to the eighth signal line, a third port coupled to the fifth set of radiating elements, and a fourth port coupled to the sixth set of radiating elements, wherein the seventh and eighth signal lines of the third sub-array are coupled to the output port of the main coupler, and the fifth and sixth signal lines of the second sub-array are coupled to the fourth output port of the main coupler.

30. An antenna according to claim 28 wherein the antenna is a land-based mobile wireless communications network antenna.

31. A land-based mobile wireless communications network including an antenna according to claim 28.

32. A mobile wireless communications network base station comprising a plurality of antennas each having a beam width which is adjustable independently of the beam width of the other antennas, wherein each antenna has a beam angle which is adjustable independently of the beam angle of the other antennas each said antenna including a phase shifter for adjusting the beam width, wherein the phase shifter is an electromechanical phase shifter which adjusts beam width by means of relatively moving components.

33. A mobile wireless communications network base station comprising a plurality of antennas each having a beam width which is adjustable independently of the beam width of the other antennas, wherein each antenna has a beam angle which is adjustable independently of the beam angle of the other antennas wherein each antenna further includes a power coupler including a differential phase shifter for differentially adjusting the relative phase between signals on a pair of signal line and a hybrid coupler which is coupled to the pair of signal lines.

34. A base station according to claim 33 wherein the beam width is adjustable in the azimuth direction.

35. A base station according to claim 33 wherein the beam width is adjustable in the elevation direction.

36. A base station according to claim 33 wherein each beam angle is adjustable in the azimuth direction.

37. A base station according to claim 33 wherein each beam angle is adjustable in the elevation direction.

38. A base station according to claim 37 wherein each antenna includes an array of radiating elements for transmitting and/or receiving radiation via a beam having an elevation beam width and an azimuth beam width; and an elevation beam width adjuster for adjusting the elevation beam width substantially independently of the azimuth beam width, whereby the elevation beam width can be adjusted with substantially no variation in the azimuth beam width.

39. A base station according to claim 33 including six or more antennas.

40. A base station according to claim 33 wherein each antenna includes a phase shifter for adjusting beam width.

41. An antenna including 2n+1 radiating modules; and a cascaded network of 2n−1 variable power couplers for varying the division of power between the radiating modules.

42. An antenna according to claim 41 wherein each radiating module includes a plurality of radiating elements.

43. An antenna according to claim 42 wherein each radiating module includes a substantially straight line of radiating elements.

44. An antenna according to claim 41 including 2n+1 rows of radiating elements; a first cascaded network of 2n−1 variable power couplers for varying the division of power between the rows of radiating elements; 2m+1 columns of radiating elements; and a second cascaded network of 2m−1 variable power couplers for varying the division of power between the columns of radiating elements.

45. An antenna according to claim 41, wherein the antenna is a land-based mobile wireless communications network antenna.

46. A land-based mobile wireless communications network including an antenna according to claim 41.

47. A mobile wireless communications network base station comprising:

a plurality of antennas each having a beam width which is adjustable independently of the beam width of the other antennas;

each antenna having a beam angle which is adjustable independently of the beam angle of the other antennas; and each antenna including a power coupler including a differential phase shifter for differentially adjusting the relative phase between signals on a pair of signal lines; and a hybrid coupler which is coupled to the pair of signal lines.

48. The mobile wireless communications network base station of claim 47, wherein the phase shifter is an electromechanical phase shifter which adjusts beam width by means of relatively moving components.

49. The mobile wireless communications network base station of claim 47, wherein each beam angle is adjustable in the elevation direction.

* * * * *